US005922657A

United States Patent [19]

Camenzind et al.

[11] Patent Number: 5,922,657

[45] Date of Patent: Jul. 13, 1999

[54] β-DITHIOPHOSPHORYLATED PORPIONIC ACID IN LUBRICANTS

[75] Inventors: Hugo Camenzind, Bern; Marc Ribeaud, Delémont, both of Switzerland; Michael Fletschinger, Bad Krozingen-Biengen, Germany; Peter Rohrbach, Liestal, Switzerland

[73] Assignee: Ciba Specialty Chemicals Corporation, Tarrytown, N.Y.

[21] Appl. No.: 08/892,781

[22] Filed: Jul. 15, 1997

[30] Foreign Application Priority Data

Jul. 15, 1996 [CH] Switzerland ..... 1769/96

[51] Int. Cl.[6] ..... C10M 137/10

[52] U.S. Cl. ..... 508/430

[58] Field of Search ..... 508/430

[56] References Cited

U.S. PATENT DOCUMENTS

| | | | |
|---|---|---|---|
| 2,645,657 | 7/1953 | Rudel et al. | 260/461 |
| 2,713,018 | 7/1955 | Johnson | 508/430 |
| 4,333,841 | 6/1982 | Schmidt et al. | 252/32.7 |
| 4,544,492 | 10/1985 | Zinke et al. | 252/32.7 |
| 5,362,419 | 11/1994 | Zinke et al. | 508/430 |

FOREIGN PATENT DOCUMENTS

| | | |
|---|---|---|
| 0098809 | 3/1984 | European Pat. Off. . |
| 134784 | 2/1974 | United Kingdom . |

OTHER PUBLICATIONS

V. Ouchinnikov, et al., Reactivity of the Polycyclic Derivatives of Phosphorus Acids Engl. Translation of Org. React. (Tartusu), 15(2), 1978, 194–203.

*Primary Examiner*—Jacqueline V. Howard
*Attorney, Agent, or Firm*—Kevin T. Mansfield

[57] ABSTRACT

A description is given of compositions comprising

A) a lubricant, a metalworking fluid or a hydraulic fluid, in particular a base oil from the group consisting of the mineral, vegetable and synthetic (for example poly-α-olefin or ester) oils;

B) from 0.005 to 1.0% by weight of a compound of the formula (I)

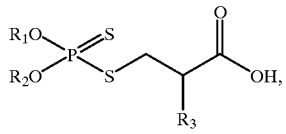

in which $R_1$ and $R_2$ independently of one another are $C_3$–$C_{18}$alkyl, $C_5$–$C_{12}$cycloalkyl, $C_5$–$C_6$cycloalkylmethyl, $C_9$–$C_{10}$bicycloalkylmethyl, $C_9$–$C_{10}$tricycloalkylmethyl, phenyl or $C_7$–$C_{24}$alkylphenyl or together are $(CH_3)_2C(CH_2)_2$, and $R_3$ is hydrogen or methyl, and, if desired, C) other customary oil additives from the groups consisting of antioxidants, metal passivators, rust inhibitors, dispersants, detergents, viscosity index improvers, pour point depressants, antifoams, solid lubricants and further antiwear additives.

12 Claims, No Drawings

β-DITHIOPHOSPHORYLATED PORPIONIC ACID IN LUBRICANTS

β-Dithiophosphorylated propionic acid in lubricants

The present invention relates to compositions comprising a lubricant (preferably an industrial oil or a grease), a metalworking or hydraulic fluid and at least one β-dithiophosphorylated propionic acid of the formula I below.

Modern lubricants are formulated with additives which perform functions such as protection against high pressure wear and corrosion and act as antioxidants [W. J. Bartz (editor) et al., "Additive für Schmierstoffe" (expert-Verlag 1994)]. Relevant in this context are zinc dialkyldithiophosphates, which combine antioxidant with high-pressure antiwear properties. In more recent times attempts have been made to replace these additives, which contain heavy metals, substantially by metal-free compounds, since this is ecologically more beneficial and has a positive effect on the durability of the exhaust-fume catalysts of internal combustion engines. In industry at present there is a need for metal-free and ash-free additives. Esters of the type:

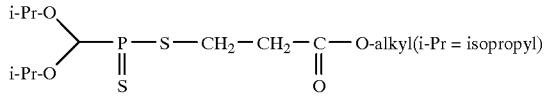

are obtainable under the trade name Irgalube™63. In addition, U.S. Pat. No. 4,333,841, describes dithiophosphorylated mercaptoacetic acids and their salts as lubricant additives.

Bis-dithiophosphoric acid derivatives are described in GB-A 2,267,493 as lubricant additives. For the same utility EP-A 98 809 [CA 101: 55323 s] proposes salts of the formula $(RO)_2P(S)S\ (CH_2)_n\ (C(O)OM$ where M=Li, K, Na or HNR. U.S. Pat. No. 5,362,419 describes as intermediates acids of the formula $(RO)_2P(S)S\ (CH_2)_2C(O)OH$ for, preparing glycol esters that are suitable as lubricant additives, for example $(RO)_2P(S)(CH_2)_2\ C(O)OCH_2\ (CHOH)CH_2OH$ (see also H. Zinke, R. Schumacher, Wear 179 (1–2) (1994) 45–8 [CA 122: 85158t]).

It has surprisingly been found that the β-dithiophosphorylated propionic acids, on which the abovementioned propionates are based, are themselves, even at very low concentrations, outstanding high-pressure and antiwear agents.

The invention therefore relates to compositions (preferably zinc- and ash-free) comprising A) a lubricant or fuel, a metalworking fluid or a hydraulic fluid, especially an industrial oil or a grease, in particular a base oil from the group consisting of mineral, vegetable and synthetic (for example poly-α-olefin or ester) oils;

B) at least one compound of the formula

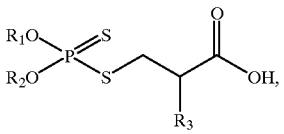

(I)

in which $R_1$ and $R_2$ independently of one another are $C_3$–$C_{18}$alkyl, $C_5$–$C_{12}$cycloalkyl, $C_5$–$C_6$cycloalkylmethyl, $C_9$–$C_{10}$bicycloalkylmethyl, $C_9$–$C_{10}$tricycloalkylmethyl, phenyl or $C_7$–$C_{24}$alkylphenyl or together are $(CH_3)_2C(CH_2)_2$, and $R^3$ is hydrogen or methyl, and, if desired, C) other customary oil additives, for example from the groups consisting of antioxidants, metal passivators, rust inhibitors, dispersants, detergents, viscosity index improvers, pourpoint depressants and other antiwear additives.

In the context of component B) $R_1$ and $R_2$ independently of one another are preferably $C_3$–$C_{18}$alkyl, $C_5$–$C_6$cycloalkyl or $C_7$–$C_{18}$alkylphenyl.

In the context of component B) $R_1$ and $R_2$ are, with particular preference, i-propyl, i-butyl or 2-ethylhexyl and $R_3$ is, with particular preference, hydrogen. Where $R_1$ and $R_2$ in the above formula I are $C_3$–$C_{18}$alkyl they are branched or unbranched radicals. Examples of these are propyl, isopropyl, n-butyl, isobutyl, t-butyl, pentyl, isopentyl, hexyl, heptyl, 3-heptyl, octyl, 2-ethylhexyl, nonyl, decyl, undecyl, dodecyl, tridecyl, tetradecyl, pentadecyl, hexadecyl, heptadecyl, octadecyl, 2-ethylbutyl, 1-methylpentyl, 1,3-dimethylbutyl, 1,1,3,3-tetramethylbutyl, 1-methylhexyl, isoheptyl, 1-methylheptyl, 1,1,3-trimethylhexyl and 1-methylundecyl.

$R_1$ and $R_2$ as $C_5$–$C_2$cycloalkyl can, for example, be cyclopentyl, cyclohexyl, cycloheptyl, cyclooctyl or cyclododecyl. Cyclopentyl and cyclohexyl are preferred, especially cyclohexyl.

$R_1$ and $R_2$ as $C_5$–$C_6$cycloalkylmethyl are cyclopentylmethyl and, in particular, cyclohexylmethyl.

$R_1$ and $R_2$ as $C_9$–$C_{10}$bicycloalkylmethyl are, for example, decalinylmethyl. As $C_9$–$C_{10}$tricycloalkylmethyl $R_1$ and $R_2$ preferably have the meaning of a group of the formula

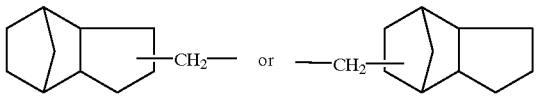

Examples of alkylphenyl are methylphenyl, dimethylphenyl, trimethylphenyl, ethylphenyl, isopropylphenyl, t-butylphenyl, di-t-butylphenyl and 2,6-di-t-butyl-4-methylphenyl.

The invention also relates to the use of component B) as additives in lubricants (industrial oils or greases), hydraulic fluids or metalworking fluids, preferably in hydraulic oils and transmission fluids. The use according to the invention includes the protection of metal parts to be lubricated against mechanical wear (high-pressure and wear protection) and also an anticorrosion effect. Consequently, the present invention likewise relates to a method of improving the service properties of lubricants, metalworking fluids and hydraulic fluids, which comprises adding compounds of the formula I thereto.

The above-mentioned lubricants or fuels (for example industrial oils and greases), metalworking fluids and hydraulic fluids of component A) are based, for example, on mineral or synthetic oils or mixtures thereof. The lubricants are familiar to the skilled worker and are described in the relevant technical literature, for example in Dieter Klamann, "Schmierstoffe und verwandte Produkte" (Verlag Chemie, Weinheim, 1982), in Schewe-Kobek, "Das Schmiermittel-Taschenbuch" (Dr. Alfred Hüthig-Verlag, Heidelberg, 1974) and in "Ullmanns Enzyklopädie der technischen Chemie", vol.14, pages 85–94 (Verlag Chemie, Weinheim, 1977).

The lubricants are especially oils and greases, based for example on a mineral oil. Oils are preferred.

Another group of lubricants which may be employed comprises vegetable or animal oils, fats, tallows and waxes or mixtures thereof with one another or with the above-mentioned mineral or synthetic oils. Examples of vegetable and animal oils, fats, tallows and waxes are palm kernel oil, palm oil, olive oil, colza oil, rapeseed oil, linseed oil, groundnut oil, soya bean oil, cotton seed oil, sunflower oil, pumpkin seed oil, coconut oil, maize oil, castor oil, walnut oil and mixtures thereof, fish oils, tallows from slaughtered animals, such as bovine tallow, neat's-foot and bone oil and also the modified, epoxidized and sulfoxidized forms thereof, for example epoxidized soya bean oil. The mineral oils are based, in particular, on hydrocarbon compounds.

Examples of synthetic lubricants comprise lubricants based on aliphatic or aromatic carboxyl esters, polymeric esters, polyalkylene oxides, phosphoric esters, poly-α-olefins or silicones, on a diester of a dibasic acid with a monohydric alcohol, for example dioctyl sebacate or dinonyl adipate, on a triester of trimethylolpropane with a monobasic acid or with a mixture of such acids, for example trimethylolpropane tripelargonate, trimethylolpropane tricaprylate or mixtures thereof, on a tetraester of pentaerythritol with a monobasic acid or with a mixture of such acids, for example pentaerythritol tetracaprylate, or on a complex ester of monobasic and dibasic acids with polyhydric alcohols, for example a complex ester of trimethylolpropane with caprylic and sebacic acid or a mixture thereof. Particularly suitable examples other than mineral oils are poly-α-olefins, ester-based lubricants, phosphates, glycols, polyglycols and polyalkylene glycols, and mixtures thereof with water.

Industrial oils, greases, metalworking fluids and hydraulic fluids can be prepared on the basis of the same substances as described above for the lubricants. In many cases the compositions involved are also emulsions of such substances in water or other liquids.

Lubricant compositions in accordance with the invention are used, for example, in internal combustion engines, for example in motor vehicles fitted, for example, with engines of the Otto, Diesel, two-stroke, Wankel or orbital type.

The component B is also suitable as an additive for fuels in motor vehicles fitted with engines of the specified type.

The compounds of the formula I are readily soluble in lubricants, fuels, metalworking fluids and hydraulic fluids and are therefore of particular suitability as additives to lubricants, metalworking fluids and hydraulic fluids.

The compositions advantageously include from 0.005 to 1.0% by weight of a compound of the formula I, preferably 0.005–0.1% by weight, in particular 0.005–0.05% by weight.

The compounds of the formula I can be introduced into the lubricants or fuels in a manner known per se. The compounds are readily soluble in oils, for example. It is also possible to prepare a so-called masterbatch which can be diluted with the corresponding lubricant to use concentrations at the rate at which they are consumed. In such cases, concentrations of more than 1% by weight are also possible.

The lubricants or fuels, metalworking and hydraulic fluids stabilized in accordance with the invention may additionally include other additives, which are added in order to improve still further the basic properties of these formulations; such additives include antioxidants, metal passivators, other rust inhibitors, viscosity index improvers, pour point depressants, solid lubricants, dispersants, detergents, antifoams, further high-pressure additives, antiwear additives and additives which reduce the coefficient of friction. Such additives are added in the customary amounts in each case in the range from in each case about 0.01 to 10.0% by weight.

The text below gives examples of such additional additives:

EXAMPLES OF PHENOLIC ANTIOXIDANTS 1.1. Alkylated monophenols, for example 2,6-di-tert-butyl-4-methylphenol, 2-butyl-4,6-dimethylphenol, 2,6-di-tert-butyl-4-ethylphenol, 2,6-di-tert-butyl-4-n-butylphenol, 2,6-di-tert-butyl-4-iso-butylphenol, 2,6-di-cyclopentyl-4-methylphenol, 2-(a-methyl-cyclohexyl)-4,6-dimethylphenol, 2,6-di-octadecyl-4-methylphenol, 2,4,6-tri-cyclo-hexylphenol, 2,6-di-tert-butyl-4-methoxymethylphenol, linear or sidechain-branched nonylphenols, for example 2,6-di-nonyl-4-methylphenol, 2,4-dimethyl-6-(1'-methyl-undec-1'-yl)phenol, 2,4-dimethyl-6-(1'-methylheptadec-1'-yl)phenol, 2,4-dimethyl-6-(1'-methyltridec-1'-yl)phenol and mixtures thereof.

1.2. Alkylthiomethylphenols, for example 2,4-di-octylthiomethyl-6-tert-butylphenol, 2,4-di-octylthiomethyl-6-methylphenol, 2,4-di-octylthiomethyl-6-ethylphenol, 2,6-di-dodecylthiomethyl-4-nonylphenol.

1.3. Hydroquinones and alkylated hydroquinones, for example 2,6-di-tert-butyl-4-methoxyphenol, 2,5-di-tert-butylhydroquinone, 2,5-di-tert-amylhydroquinone, 2,6-diphenyl-4-octadecyloxyphenol, 2,6-di-tert-butyl-hydroquinone, 2,5-di-tert-butyl-4-hydroxyanisole, 3,5-di-tert-butyl-4-hydroxyanisole, 3,5-di-tert-butyl-4-hydroxyphenyl stearate, bis(3,5-di-tert-butyl-4-hydroxyphenyl) adipate.

1.4. Tocopherols, for example α-, β-, γ- or δ-tocopherol and mixtures thereof (vitamin E).

1.5. Hydroxylated thiodiphenyl ethers, for example 2,2'-thiobis(6-tert-butyl-4-methylphenol), 2,2'-thiobis(4-octylphenol), 4,4'-thiobis(6-tert-butyl-3-methylphenol), 4,4'-thiobis-(6-tert-butyl-2-methylphenol), 4,4'-thiobis(3,6-di-sec.-amylphenol), 4,4'-bis(2,6-dimethyl-4-hydroxyphenyl) disulfide.

1.6. Alkylidenebisphenols, for example 2,2'-methylenebis(6-tert-butyl-4-methylphenol), 2,2'-methylenebis(6-tert-butyl-4-ethylphenol), 2,2'-methylenebis[4-methyl-6-(α-methylcyclohexyl)-phenol], 2,2'-methylenebis(4-methyl-6-cyclohexylphenol), 2,2'-methylenebis(6-nonyl-4-methylphenol), 2,2'-methylenebis(4,6-di-tert-butylphenol), 2,2'-ethylidenebis(4,6-di-tert-butylphenol), 2,2'-ethylidenebis(6-tert-butyl-4-isobutylphenol), 2,2'-methylenebis[6-(α-methylbenzyl)-4-nonylphenol], 2,2'-methylene-bis[6-(αα-dimethylbenzyl)-4-nonylphenol], 4,4'-methylenebis(2,6-di-tert-butylphenol), 4,4'-methylenebis(6-tert-butyl-2-methylphenol), 1,1-bis(5-tert-butyl-4-hydroxy-2-methylphenyl)butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methylphenyl)-3-n-dodecylmercaptobutane, ethylene glycol bis[3,3-bis(3'-tert-butyl-4'-hydroxyphenyl)butyrate], bis(3-tert-butyl-4-hydroxy-5-methylphenyl)dicyclo-pentadiene, bis[2-(3'-tert-butyl-2'-hydroxy-5'-methylbenzyl)-6-tert-butyl-4-methylphenyl]terephthalate, 1,1 -bis(3,5-dimethyl-2-hydroxyphenyl)butane, 2,2-bis(3,5-di-tert-butyl-4-hydroxyphenyl)propane, 2,2-bis(5-tert-butyl-4-hydroxy-2-methylphenyl)-4-n-dodecylmercaptobutane, 1,1,5,5-tetra(5-tert-butyl-4-hydroxy-2-methylphenyl)-pentane.

1.7. O- N- and S-benzyl compounds, for example 3,5,3',5'-tetra-tert-butyl-4,4'-dihydroxydibenzyl ether, octadecyl 4-hydroxy-3,5-dimethylbenzylmercaptoacetate, tridecyl 4-hydroxy-3,5-di-tert-butylbenzylmercaptoacetate, tris(3,5-di-tert-butyl)amine, bis(4-tert-butyl-3-hydroxy-2,6-dimethylbenzyl)dithioterephthalate, bis(3,5-di-tert-butyl-4-hydroxybenzyl) sulfide, isooctyl 3,5-di-tert-butyl-4-hydroxy-benzylmercaptoacetate.

1.8. Hydroxybenzylated malonates, for example-dioctadecyl 2,2-bis(3,5-di-tert-butyl-2-hydroxybenzyl) malonate, dioctadecyl 2-(3-tert-butyl-4-hydroxy-5-methylbenzyl)-malonate, di-dodecyl mercaptoethyl-2,2-bis(3,5-di-tert-butyl-4-hydroxybenzyl)-malonate, di[4-(1,1,3,3-tetramethylbutyl)phenyl]2,2-bis(3,5-di-tert-butyl-4-hydroxybenzyl)malonate.

1.9. Aromatic hydroxybenzyl compounds, for example 1,3,5-tris(3,5-di-tert-butyl-4-hydroxybenzyl)-2,4,6-trimethylbenzene, 1,4-bis(3,5-di-tert-butyl-4-hydroxybenzyl)-2,3,5,6-tetramethylbenzene, 2,4,6-tris(3,5-di-tert-butyl-4-hydroxybenzyl)phenol.

1.10. Triazine compounds, for example 2,4-bisoctylmercapto-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl)-isocyanurate, 1,3,5-tris(4-tert-butyl-3-hydroxy- 2,6-dimethylbenzyl) isocyanurate, 2,4,6-tris(3,5-di-tert-butyl-4-hydroxyphenylethyl)-1,3,5-triazine, 1,3,5-tris(3,5-di-tert-butyl-4-hydroxyphenylpropionyl)hexahydro-1,3,5-triazine, 1,3,5-tris(3,5-dicyclohexyl-4-hydroxybenzyl)-isocyanurate.

1.11. Benzylphosphonates, for example dimethyl 2,5-di-tert-butyl-4-hydroxybenzyl-phosphonate, diethyl 3,5-di-tert-butyl-4-hydroxybenzylphosphonate, dioctadecyl 3,5-di-tert-butyl-4-hydroxybenzylphosphonate, dioctadecyl 5-tert-butyl-4-hydroxy-3-methylbenzylphosphonate, the calcium salt of the monoethyl ester of 3,5-di-tert-butyl-4-hydroxybenzylphosphonic acid.

1.12. Acylaminophenols, for example 4-hydroxylauranilide, 4-hydroxystearanilide, octyl N-(3,5-di-tert-butyl-4-hydroxyphenyl)carbamate.

1.14. Esters of β-(3,5-di-tert-butyl-4-hydroxyphenyl) propionic acid, β-(5-tert-butyl-4-hydroxy-3-methylphenyl) propionic acid, β-(3,5-dicyclohexyl-4-hydroxyphenyl)-propionic acid, 3,5-di-tert-butyl-4-hydroxyphenylacetic acid or β-(5-tert-butyl-4-hydroxyphenyl)-3-thiabutyric acid with mono- or polyhydric alcohols, e.g. with methanol, ethanol, n-octanol, i-octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl)oxalamide, 3-thiaundecanol, 3-thiapentadecanol, trimethyl-hexanediol, trimethylolpropane, 4-hydroxymethyl-1-phospha-2,6,7-trioxabicyclo[2.2.2]octane, glycerol and transesterification products based on natural triglycerides of, for example, coconut oil, rape seed oil, sunflower oil or colza oil.

1.14. Amides of β-(3,5-di-tert-butyl-4-hydroxyphenyl) propionic acid, e.g. N,N'-bis(3,5-di-tert-butyl-4-hydroxyphenylpropionyl)hexamethylenediamine, N,N'-bis(3,5-di-tert-butyl-4-hydroxyphenylpropionyl) trimethylenediamine, N,N'-bis(3,5-di-tert-butyl-4-hydroxyphenylpropionyl)hydrazine.

1.15. Ascorbic acid (vitamin C).

1.16.Amine-type antioxidants, for example N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methyl-pentyl)-p-phenylenediamine, N,N'-bis(1-methyl-heptyl)-p-phenylendiamine, N,N'-dicyclohexyl-p-phenylenediamine, N,N'-diphenyl-p-phenylenediamine, N,N'-di-(naphth-2-yl)-p-phenylenediamine, N-isopropyl-N'-phenyl-p-phenylenediamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido) diphenylamine, N, N'-dimethyl-N,N'-di-sec-butyl-p-phenylenediamine, diphenylamine, N-allyldiphenylamine, 4-isopropoxy-diphenylamine, N-phenyl-1-naphthylamine, N-(4-tert-octylphenyl)-1-naphthylamine, N-phenyl-2-naphthylamine, octylated diphenylamine, e.g. p,p'-di-tert-octyidiphenyl-amine, 4-n-butylaminophenol, 4-butyrylamino-phenol, 4-nonanoylamino-phenol, 4-dodecanoylaminophenol, 4-octadecanoylamino-phenol, di-(4-methoxyphenyl)-amine, 2,6-di-tert-butyl-4-dimethylamino-methyl-phenol, 2,4'-diamino-diphenylmethane, 4,4'-diamino-diphenylmethane, N,N,N',N'-tetramethyl-4,4'-diamino-diphenylmethane, 1,2-di-[(2-methyl-phenyl)-amino]-ethane, 1,2-di-(phenylamino) propane, (o-tolyl)biguanide, di[4-(1',3'-dimethyl-butyl)-phenyl]amine, tert-octylated N-phenyl-1-naphthylamine, a mixture of mono- and dialkylated tert-butyl/tert-octyidiphenylamines, a mixture of mono- and dialkylated nonyldiphenylamines, a mixture of mono- and dialkylated dodecyldiphenylamines, a mixture of mono- and dialkylated isopropyl/isohexyldiphenylamines, mixtures of mono- and dialkylated tert-butyidiphenylamines, 2,3-dihydro-3,3-dimethyl-4H-1,4-benzothiazine, phenothiazine, a mixture of mono- and dialkylated tert-butyl/tert-octyl-phenothiazines, a mixture of mono- and dialkylated tert-octyl-phenothiazines, N-allylphenothiazine, N,N,N',N'-tetraphenyl-1,4-diaminobut-2-ene, N,N-bis-(2,2,6,6-tetramethylpiperidin-4-yl)hexamethylenediamine, bis-(2,2,6,6-tetramethylpiperidin-4-yl) sebacate, 2,2,6,6-tetramethylpiperidin-4-one, 2,2,6,6-tetramethylpiperidin-4-ol.

EXAMPLES OF FURTHER ANTIOXIDANTS

Aliphatic or aromatic phosphites, esters of thiodipropionic acid or of thiodiacetic acid, or salts of dithiocarbamic or dithiophosphoric acid, 2,2,12,12-tetramethyl-5,9-dihydroxy-3,7,1 -trithiatridecane and 2,2,15,15-tetramethyl-5,12-dihydroxy-3,7,10,14-tetrathiahexadecane.

Examples of metal passivators, for example for copper, are:

a) benzotriazoles and their derivatives, for example 4- or 5-alkylbenzotriazoles (e.g. tolutriazole) and derivatives thereof, 4,5,6,7-tetrahydrobenzotriazole, 5,5'-methylenebisbenzotriazole; Mannich bases of benzotriazole or tolutriazole, such as 1-[di(2-ethylhexyl) aminomethyl]tolutriazole and 1 -[di(2-ethylhexyl) aminomethyl]-benzotriazole; alkoxyalkylbenzotriazoles, such as 1-(nonyloxymethyl)-benzotriazole, 1-(1-butoxyethyl)-benzotriazole and 1-(1-cyclohexyloxybutyl)-tolutriazole.

b) 1,2,4-triazoles and derivatives thereof, for example 3-alkyl(or aryl)-1,2,4-triazoles, Mannich bases of 1,2,4-triazoles such as 1-[di(2-ethylhexyl)aminomethyl]-1,2,4-triazole; alkoxyalkyl-1,2,4-triazoles such as 1-(1-butoxyethyl)-1,2,4-triazole; acylated 3-amino-1,2,4-triazoles.

c) imidazole derivatives, for example 4,4'-methylenebis(2-undecyl-5-methyl-imidazole), bis[(N-methyl) imidazol-2-yl]carbinol octyl ether.

d) Sulfur-containing heterocyclic compounds, for example 2-mercaptobenzothiazole, 2,5-dimercapto-1,3,4-thiadiazole, 2,5-dimercaptobenzothiadiazole and derivatives thereof; 3,5-bis[di(2-ethylhexyl) aminomethyl]-1,3,4-thiadiazolin-2-one.

e) Amino compounds, for example salicylidenepropylenediamine, salicylaminoguanidine and salts thereof.

Examples of rust inhibitors are:

a) Organic acids, their esters, metal salts, amine salts and anhydrides, for example alkyl- and alkenylsuccinic acids and the partial esters thereof with alcohols, diols or hydroxycarboxylic acids, partial amides of alkyl- and alkenylsuccinic acids, 4-nonylphenoxyacetic acid, alkoxy- and alkoxyethoxycarboxylic acids, such as dodecyloxyacetic acid, dodecyloxy(ethoxy)acetic acid and the amine salts thereof, and also N-oleoylsarcosine, sorbitan monooleate, lead naphthenate, alkenylsuccinic anhydrides, for example dodecenylsuccinic anhydride, 2-(2-carboxyethyl)-1-dodecyl-3-methylglycerine and its salts, especially sodium and triethanolamine salts.

b) Nitrogen-containing compounds, for example:

i. Primary, secondary or tertiary aliphatic or cycloaliphatic amines and amine salts of organic and inorganic acids, for example oil-soluble alkylammonium carboxylates, and also 1-[N,N-bis(2-hydroxyethyl)amino]-3-(4-nonylphenoxy)propan-2-ol.

ii. Heterocyclic compounds, for example: substituted imidazolines and oxazolines, 2-heptadecenyl-1-(2-hydroxyethyl)-imidazoline.

c) Phosphorus-containing compounds, for example Amine salts of phosphoric acid partial esters or phosphonic acid partial esters, zinc dialkyldithiophosphates.

d) Sulfur-containing compounds, for example: barium dinonylnaphthalene-sulfonates, calcium petroleumsulfonates, alkylthio-substituted aliphatic carboxylic acids, esters of aliphatic 2-sulfocarboxylic acids and salts thereof.

e) Glycerine derivatives, for example: glycerine monooleate, 1-(alkylphenoxy)-3-(2-hydroxyethyl) glycerines, 1-(alkylphenoxy)-3-(2,3-dihydroxypropyl) glycerines, 2-carboxyalkyl-1,3-dialkylglycerines.

Examples of viscosity index improvers are: polyacrylates, polymethacrylates, vinylpyrrolidone/methacrylate copolymers, polyvinylpyrrolidones, polybutenes, olefin copolymers, styrene/acrylate copolymers, polyethers.

Examples of pour point depressants are: polymethacrylate, alkylated naphthalene derivatives.

Examples of dispersants/surfactants are: polybutenylsuccinamides or -imides, polybutenylphosphonic acid derivatives, and basic magnesium, calcium and barium sulfonates and phenolates.

Examples of antifoams are: silicone oils and Polymethocrylen

Examples of solid lubricants are: Teflon™ or molybdenum sulfide.

Examples of wear control additives are: sulfur- and/or phosphorus- and/or halogen-containing compounds, such as sulfurized olefins and vegetable oils, zinc dialkyldithiophosphates, tritolyl phosphate, tricresyl phosphate, chlorinated paraffins, alkyl and aryl di- and trisulfides, amine salts of mono- and dialkyl phosphates, amine salts of methylphosphonic acid, diethanolaminomethyltolyltriazole, di(2-ethylhexyl)-aminomethyltolyltriazole, derivatives of 2,5-dimercapto-1,3,4-thiadiazole, ethyl [(bisisopropyloxyphosphinothioyl) thio]propionate, triphenyl thiophosphate (triphenyl phosphorothioate), tris(alkylphenyl) phosphorothioates and mixtures thereof (for example tris(isononylphenyl) phosphorothioate), diphenylmonononylphenyl phosphorothioate, isobutylphenyl diphenyl phosphorothioate, the dodecylamine salt of 3-hydroxy-1,3-thiaphosphetan 3-oxide, trithiophosphoric acid 5,5,5-tris [isooctyl 2-acetate], derivatives of 2-mercaptobenzothiazole, such as 1-[N,N-bis(2-ethylhexyl) aminomethyl]-2-mercapto-1H-1,3-benzothiazole, and ethoxycarbonyl 5-octyldithiocarbamate.

The compounds of the formula I and their preparation are known per se. They serve primarily as intermediates for various products and applications, as described for example in V. V. Ovchinnikov et al., Org. React (Tartu) 15(2) (1978), 194–203 (engl.) [CA 90: 120801s] and in L. A. Belova et al., Zh. Obshch. Khim 51 (9) (1981) 1982–88 (Russ.) [CA 96:103597 m].

The compounds according to the invention are prepared, for example, in accordance with the following equation:

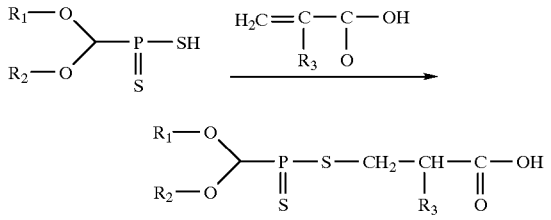

This synthesis of β-dithiophosphorylated propionic acid by addition of dithiophosphoric acid onto acrylic or methacrylic acid is known and is described, for example, in U.S. Pat. No. 5,362,419 (Ex. 1–11). Examples 1–3 below document the synthesis of some of the β-dithiophosphorylated propionic acids used in the compositions according to the invention. Parts and percentages are by weight unless stated otherwise.

[MW 286.34]

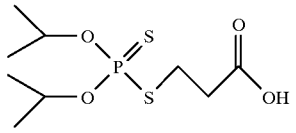

EXAMPLE 1

7.2 g (0.1 mol) of acrylic acid are added dropwise at 80° C. over the course of 20 minutes to 21.4 g (0.1 mol) of O,O-diisopropyldithiophosphoric acid in 50 ml of toluene. Stirring is continued at 80° C. for 5 h. After the solvent has been stripped off on a rotary evaporator the residue is fractionated by column chromatography on silica gel to give 11.8 g of a yellow, liquid main product (41% of theory).

Analysis: 37.99% C (calculated 37.75) 6.76% H (calculated 6.69) 22.17% S (calculated 22.39) 10.80% P (calculated 10.82);

$^{31}$P-NMR (relative to $H_3PO_4$): 91.84 ppm.

[MW 314.4]

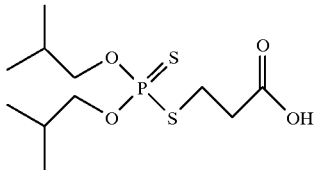

EXAMPLE 2

81.4 g (1.1 mol) of acrylic acid are added dropwise at 70° C. over the course of 1 h to 252.4 g (0.1 mol) of O,O-diisobutyldithiophosphoric acid, and stirring is continued at 70° C. for 4 h. The crude product is dissolved in 500 ml of 2N sodium hydroxide and washed with twice 300 ml of petroleum spirit (boiling range 80°–110° C.). The solution is then acidified to a pH of 1 using concentrated hydrochloric acid and subjected to extraction with about 150 ml of petroleum spirit. The organic phase is washed with water and concentrated on a rotary evaporator to give 287.6 g of clear, pale yellow oil of medium viscosity (91% of theory).

Analysis: 42.02% C (calculated 42.62) 7.29% H (calculated 7.37), 20.29% S (calculated 20.40) 10.2% P (calculated 9.85);

$n^{20}D$: 1.5006;

$^1$H-NMR (in $CDCl_3$ solution, relative to tetramethylsilane):

1.02 ppm (d, 12H), 2.05 ppm (hept, 2H), 2.86 ppm (t, 2H), 3.17 ppm (d×t, 2H), 3.89 ppm (d×hept, 4H).

[MW 426.6]

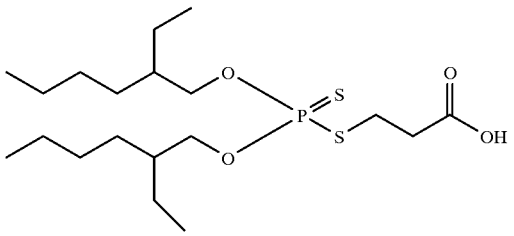

EXAMPLE 3

7.21 g (1.1 mol) of acrylic acid are added dropwise at 750° C. over the course of 15 minutes to 35.5 g (0.1 mol) of O,O-di(2-ethylhexyl)dithiophosphoric acid in 50 ml of toluene. Stirring is continued at 75° C. for 5 h. The mixture is worked up as in Example 1 to give 21.8 g of yellowish oil (51% of theory).

Analysis: 53.86% C (calculated 53.62) 9.23% H (calculated 9.0), 15.77% S (calculated 15.07) 7.3% P (calculated 7.26)

The advantages of the compositions lie in the antiwear properties and, in particular, in the very good load-bearing properties, especially for hydraulic and transmission fluids, with relatively small amounts of β-dithiophosphorylated propionic acids surprisingly being sufficient. As a result it is possible to minimize any negative side effects such as corrosiveness for copper and incompatibility with any calcium compounds present (precipitation reactions). Moreover, an additional corrosion protection potential is provided.

Hydraulic fluids and transmission fluids are required to have both very good antiwear (AW) properties and a very good extreme-pressure (EP) load-bearing capacity.

Using known, metal-free phosphorous/sulfur additives [W. J. Bartz et al., "Additive für Schmierstoffe" (1994), p. 88–116] it is relatively simple to achieve good antiwear properties. However, it is not very easy to ensure an excellent load-bearing capacity, especially for transmissions. The FZG gear wheel test described below is used as a model system for transmission fluids and gives information on the load-bearing capacity (see Example 4 below).

Excellent values in the FZG test (load stage at failure>12) are difficult to achieve with the customary antiwear additives at low concentrations (less than 0.2%). Surprisingly, however, relatively low concentrations of compounds of the formula I (just 0.005–0.05%) give FZG values ranging from very good to excellent (cf. Table 1, columns eight and ten).

EXAMPLE 4

The following formulations below were tested in the FZG transmission test (as described in DIN 51,354, A/8.3/90) (Table 1). This test assesses the load-bearing capacity of lubricants for use as transmission fluids. Immersed in the lubricating oil under test, defined gear wheels run at constant speed and with a fixed initial oil temperature. The load exerted by the gear wheels is raised level by level. From power level 4 onwards, after each power level the change in the flanks of the gear wheel teeth is ascertained by description and possibly by photography, roughness measurement or contrast impression. The limit load level is one level below the load level at failure, i.e. that level at which the flanks of at least two gear wheels show clear damage (cracks or the like).

| | Type A gear wheels, 8.3 m/s, 90° C. Additives (parts) | | | | | | | | | |
|---|---|---|---|---|---|---|---|---|---|---|
| Base oil[1] | 100 | ad 100 | ad 100 | ad 100 | ad 100 | ad 100 | ad 100 | ad 100 | ad 100 | ad 100 |
| Basic formulation | | 0.51 | 0.51 | 0.51 | 0.51 | 0.51 | 0.51 | 0.51 | 0.51 | 0.51 |
| AW 1[2] | | | 0.5 | | | | | | | |
| AW 2[3] | | | | | | 0.5 | | | | |
| AW 3[4] | | | | | | | 0.56 | 0.56 | | |
| AW 4[5] | | | | | | | | | 0.4 | 0.4 |
| Ex. 2 | | | | 0.005 | 0.05 | | | 0.02 | | 0.02 |
| FZG limit load stage | 7 | 7 | 8 | 10 | 12 | 11 | 8 | >12 | 8 | 12 |

Basic formulation: Irganox ™ L 135[6]: 0.3%; Irganox ™ L 57[7]: 0.1%; Hitec ™ 536[8]: 0.07%; Irgamet ™ 39[9]: 0.04%.

[1]Base oil: ISO VG 46 ex Texaco;

[2]AW 1: Irgalube ™ TPPT (triphenyl thionophosphates)

[3]AW 2: Irgalube ™ 63 {ethyl 3-[(bisisopropyloxyphosphinothioyl)thio]propionate}

[4]AW 3: liquid mixture of tri[(alk)aryl] thionophosphates, consisting essentially of tri(nonylphenyl) thionophosphate (as described in EP 368 803 beschrieben);

[5]AW 4: bis(O,O-dialkyl dithiophosphate)

[6]

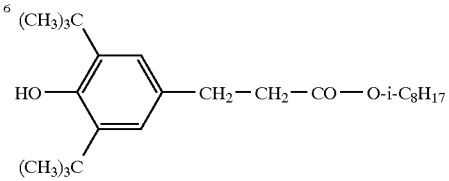

[7]Mixture of diphenylamine compounds, obtainable commercially as Irganox ™ L-57, cf. US-5,073,278, col. 2, line 50

-continued

| Type A gear wheels, 8.3 m/s, 90° C. Additives (parts) |
|---|
| [8] Hitec™ 536, $H_{23}C_{12}$—CH(COOH)·$CH_2$—CO-NH—$CH_2$—$CH_2$— 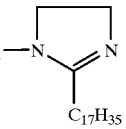 |

[9] 1-[Bis(2-ethylhexyl)aminomethyl]-4-methylbenzotriazole

What is claimed is:

1. A composition comprising

A) a lubricant, a metalworking fluid or a hydraulic fluid;

B) at least one compound of the formula (I)

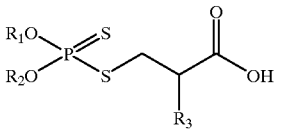

in which $R_1$ and $R_2$ independently of one another are $C_3$–$C_{18}$alkyl, $C_5$–$C_{12}$cycloalkyl, $C_5$–$C_6$cycloalkylmethyl, $C_9$–$C_{10}$bicycloalkylmethyl, $C_9$–$C_{10}$tricycloalkylmethyl, phenyl or $C_7$–$C_{24}$alkylphenyl or together are $(CH_3)_2C(CH_2)_2$, and $R_3$ is hydrogen or methyl, and, if desired, C) other customary oil additives.

2. A composition according to claim 1 containing from 0.005 to 0.01% by weight of a compound of the formula I.

3. A composition according to claim 1 containing 0.005–0.05% by weight of a compound of the formula I.

4. A composition according to claim 1, in which component A) is an industrial oil or a grease.

5. A composition according to claim 1, in which component A) is a base oil from the group consisting of mineral, vegetable and synthetic oils.

6. A composition according to claim 1, in which $R_1$ and $R_2$ independently of one another are $C_3$–$C_{18}$alkyl, $C_5$–$C_6$cycloalkyl or $C_7$–$C_{18}$alkylphenyl.

7. A composition according to claim 1, in which $R_1$ and $R_2$ are i-propyl, i-butyl or 2-ethylhexyl, and $R_3$ is hydrogen.

8. A composition according to claim 1, which additionally comprises C) other oil additives from the groups consisting of antioxidants, metal passivators, rust inhibitors, dispersants, detergents, antifoams, solid lubricants, viscosity index improvers, pour point depressants and antiwear additives.

9. A method of improving the service properties of lubricants, hydraulic fluids or metalworking fluids, which comprises adding thereto at least one compound of the formula I as described in claim 1.

10. A method according to claim 9 for improving the service properties of hydraulic fluids or transmission oils.

11. A zinc-free composition according to claim 1.

12. An essentially ash-free composition according to claim 1.

* * * * *